United States Patent [19]

Janicki

[11] Patent Number: 4,725,078

[45] Date of Patent: Feb. 16, 1988

[54] WALLBOARD IDENTIFICATION SYSTEM

[75] Inventor: Edmund J. Janicki, North Tonawanda, N.Y.

[73] Assignee: National Gypsum Company, Dallas, Tex.

[21] Appl. No.: 880,137

[22] Filed: Jun. 30, 1986

[51] Int. Cl.[4] ..... D42D 15/00

[52] U.S. Cl. ..... 283/70; 52/105; 283/1 R

[58] Field of Search ..... 283/70, 89, 1 R; 52/105

[56] References Cited

U.S. PATENT DOCUMENTS 2,270,419 1/1942 Debo ..... 52/105
4,157,784 6/1979 Gröttrup et al. ..... 283/89 X

FOREIGN PATENT DOCUMENTS 7410361 9/1975 Netherlands ..... 283/89
8103510 12/1981 World Int. Prop. O. ..... 283/89

*Primary Examiner*—Paul A. Bell
*Attorney, Agent, or Firm*—Robert F. Hause

[57] ABSTRACT

Gypsum wallboard, for use in drywall construction, printed with suitable identifying indicia on the face using an optical brightener which is visible only under ultra-violet light. The wallboard is identifiable as to source, after the board is installed, and even after having been painted.

10 Claims, 1 Drawing Figure

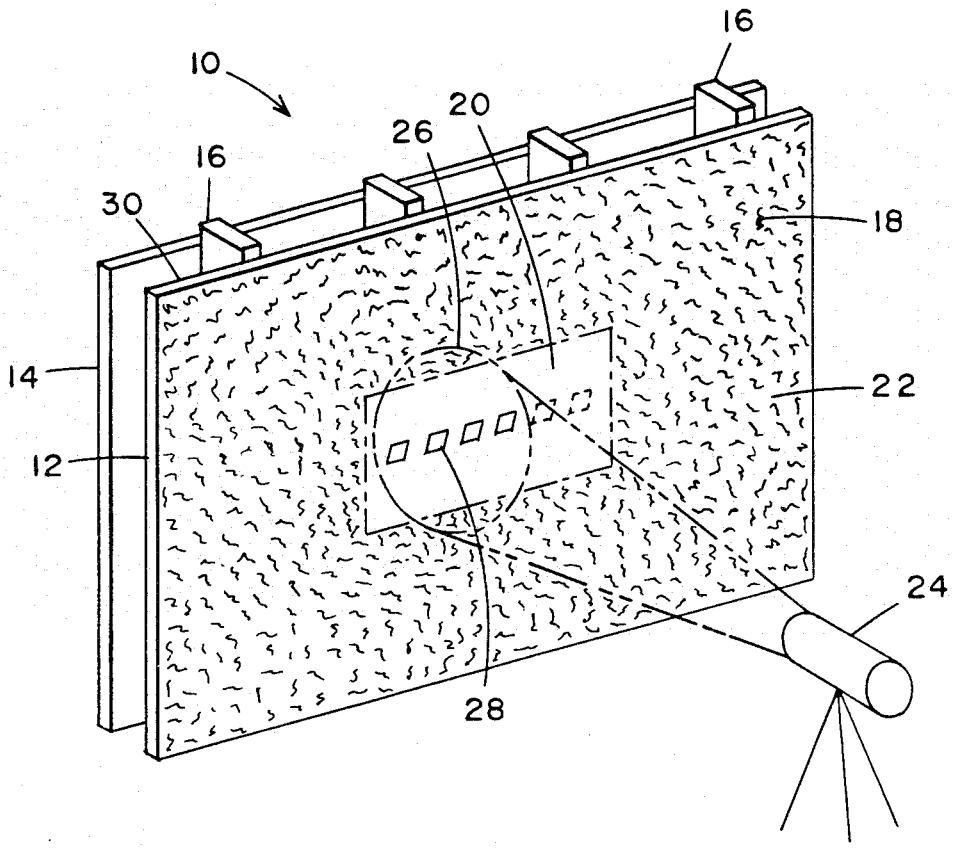
10
16
16
20
26
30
18
14
22
12
24
28

WALLBOARD IDENTIFICATION SYSTEM

BACKGROUND OF THE INVENTION

This invention relates to identifying the manufacturer of a sheet of gypsum wallboard after it has been embodied in a wall or ceiling and even if the wall or ceiling has been painted.

Presently, when a wallboard manufacturer's representative inspects a finished painted wall, in response to a complaint from a customer, there is usually no way to determine the identification of the manufacturer of the wallboard other than by removing the wallboard from the wall to read the marking on the back side of the wallboard. If the wallboard is clearly defective, but not unusable, it would be advantageous if the manufacturer's representative could identify the manufacturer of the wallboard and when appropriate make a cash settlement for the defective product rather than risk a substantially greater expense of removing the wallboard and replacing it with new wallboard.

SUMMARY OF THE INVENTION

The present invention contemplates applying normally, invisible coatings in a printed or coded form, in a consistent preplanned location on the front face of wallboard, using in the coating an optical brightener, in certain minute quantities so the coating, when dried, will be discernable only in ultraviolet light, and then only if there is no other paint or coating over the optical brightener. After the wallboard has been applied on a wall and painted, the printed or coded matter will not detract from the appearance of the wall regardless of the type of lighting in the room. The most common interior wall paints and textures can all be easily removed from the preplanned location of the printed or coded matter without removing the printed or coded matter by washing with denatured alcohol or paint remover, and, by this means, the manufacturer's identity is determined with a minimum of damage to the wall.

It is an object of the present invention to provide an improved wallboard in respect to being able to be identified at a time subsequent to its being used in its normal manner of use.

It is a further object to provide a method of identifying wallboard after its affixation in a wall and its being painted.

These and other objects and advantages of the invention will be more readily apparent when considered in relation to the preferred embodiments as set forth in the following specifications.

DESCRIPTION OF THE PREFERRED EMBODIMENTS

The method of the invention consists essentially of applying a normally invisible coating in a predesigned printed or coded form onto the face of all of the gypsum wallboard produced by a single manufacturer. This normally invisible coating consists of a vehicle and a very minute amount of material which is detectable under ultraviolet light. After a wall is constructed using such wallboard, the wall is painted. Identification of the manufacturer of the wallboard is made by removing any paint or texture which may be on the wall, using alcohol or paint remover, directing ultraviolet light on the bare wallboard, and noting the normally invisible coating in its predesigned printed or coded form.

EXAMPLE I

In a preferred embodiment of the invention a normally invisible coating material, consisting essentially of ethanol commercial denatured alcohol containing about 0.02 to 0.1% aminocoumarin, a chemical identified as $C_{14}H_{17}O_2N$ with a molecular weight of 231 and sold as Calcofluor White RW TM optical brightener by American Cyanimid Co., is applied in a prearranged pattern along a specific narrow, elongated area of the paper face of a plurality of gypsum wallboards as the wallboards are being manufactured at a gypsum board plant.

A suitable pattern and location could be a repetition of ½ inch wide parallelograms with 70° and 110° corners, about ¾ inch long printed every 2 inches along the centerline of the face of the wallboard. The amount of coating to be applied is an amount which is easily applied by a roll coating apparatus, is invisible to the eye, when dried, but is easily seen under ultraviolet light, when dried.

Gypsum wallboard coated with the repetitive parallelograms is sold in ordinary commerce, and affixed to wall framing in building construction for interior walls, or ceilings, which, after erection, are painted throughout the wallboard face, which is the only accessible surface of the board, with any available commercial interior wall or ceiling paints. By maintaining the amount of coating to less than what could be seen by the naked eye, when dried, the coating is also indiscernable to the human eye when covered with a coating of standard commercial paint or texture, even under ultraviolet light.

Anytime after the wallboard is coated with paint or texture, any person who wishes to establish whether this wallboard has the coated parallelogram pattern on it, particularly to determine the identity of the manufacturer, may remove the paint or texture from a small, 2 inch area along the centerline of the wallboard, and subject the cleaned area to ultraviolet light.

Since gypsum wallboard is substantially always made in 4 foot widths, to locate the centerline requires only locating a joint, and measuring 2 feet away from the joint, to the centerline.

Removing the paint or texture involves only known solvents, such as alcohol for removing a water based latex paint or texture or a commercial paint stripper for an oil based paint, applied and removed with known standard techniques. It has been found that the normally invisible coating of parallelograms remains sufficiently to be clearly detected when subjected to ultraviolet light.

In the drawing, there is shown a standard hollow wall 10, with wallboards 12 and 14 affixed on both faces of a series of parallel vertical studs 16. A coating of texture paint 18 has been removed within a rectangular area 20 on the front face 22 of wallboard 12. An ultraviolet light source 24 illuminates a circular area 26, causing a normally invisible coating material 28, applied in a pattern of parallelograms along the board centerline, to be easily seen where the ultraviolet lighted circular area 26 overlaps the paint removed rectangular area 20. It will be noted that the wallboard 14 on the opposite side of wall 10 from wallboard 12 would prevent a person from seeing an identifying mark on wallboard 12 if the mark had been printed on the back face 30 thereof, instead of the front face.

EXAMPLES II AND III

Other coating materials suitable for use in accordance with the present invention include:

II: An amber liquid textile brightener, anionic 9–10 pH for use in textile and laundry softeners to offset any yellowing tendencies is sold by Hilton Davis under the trademark Hiltamine Arctic White TX, and may be diluted with water to a solids content of between about 0.02% and 0.7% for use as a normally invisible coating material otherwise as described in Example I.

III: Mathews International Corporation sells a UV Readable Porous Jet-A-Mark TM Ink, an optical brightener with solids dispsered in substantially over 80% propanol, which is applied to a wallboard face using a Mathews Jet-A-Mark TM Model 1100 Non Contact Printing System using dot size setting of between 600 and 1500, in order to apply the essential amount of solids to the wallboard. The coating, thus applied, will function similar to the coating of Example I.

Additional optical brighteners, identified by their trademark and manufacturer, are as follows:

| | |
|---|---|
| Hostalux KCB | American Hoechst Corp. |
| Uvitex OB | Ciba-Geigy Corp. |
| Eastobrite OB-1 | Eastman Kodak Co. |
| Indobrite 10 | Indol Chemical Co. |
| Indobrite 20 | Indol Chemical Co. |
| Indobrite 30 | Indol Chemical Co. |
| Brite Concentrate | Merix International Corp. |
| Parabolix 100 | Merix International Corp. |
| Phorwhite KZ002 | Mobay Chemical Corp. |
| Leucopure EGM | Sandoz Inc. |
| Aclarat 8678 | Sandoz Inc. |
| Optiblanc PL | 3-V Chemical Corp. |
| Optiblanc SPL-10 | 3-V Chemical Corp. |

Having completed a detailed disclosure of the preferred embodiments of my invention, so that others may practice the same, I contemplate that variations may be made without departing from the essence of the invention.

I claim:

1. The method of identifying the manufacturer of gypsum wallboard which is affixed to wall framing and painted comprising the steps of applying a dilute solution of an optical brightener in a prearranged pattern on the face of said gypsum wallboard prior to the wallboard being painted, affixing the wallboard to wall framing such that the face of said wallboard is the only accessible surface of said wallboard, painting said wallboard face, and at some time subsequent to said painting removing a portion of said paint whereat said face has been coated with said optical brightener, and directing ultraviolet light at said area of said face from which paint has been removed and visually establishing the presence of said prearranged pattern of optical brightener.

2. The method of claim 1 wherein said dilute solution of optical brightener is about 0.02 to 0.1% aminocoumarin in ethanol.

3. The method of claim 1 wherein said prearranged pattern comprises a narrow elongate pattern disposed at a constant distance from the side edge of said wallboard.

4. A permanently identifiable gypsum wallboard comprising a gypsum wallboard, said wallboard having a front face, said face having identifying matter printed thereon by a coating material, said coating material being an optical brightener in an amount which, when dry, is substantially invisible in ordinary light and clearly visible under ultra-violet light.

5. A permanently identifiable gypsum wallboard as defined in claim 4 wherein said identifying matter is located along a narrow elongate portion of said wallboard face, at a substantially constant distance from one of the side edges of said wallboard.

6. A permanently identifiable gypsum wallboard as defined in claim 5 wherein said identifying matter is located along the elongate cetnerline of said wallboard face.

7. A permanently identifiable gypsum wallboard as defined in claim 5 wherein said identifying matter is in the form of discontinuous, repetitive uniform shapes.

8. An interior wall comprising permanently identifiable gypsum wallboard as defined in claim 4, said wallboard being firmly affixed to wall framing with said wall board face being the only accessible surface of said wallboard.

9. An interior wall as defined in claim 8 wherein said wallboard has been coated with paint.

10. An interior wall as defined in claim 8 wherein said wallboard has been coated with a texture.

* * * * *